US006647571B2

(12) United States Patent
Hynansky

(10) Patent No.: US 6,647,571 B2
(45) Date of Patent: Nov. 18, 2003

(54) BED ASSEMBLY WITH AN INSERT FOR INVALIDS

(75) Inventor: Deanna Hynansky, Greenville, DE (US)

(73) Assignee: Hawaiko, Inc., Wilmington, DE (US)

( * ) Notice: Subject to any disclaimer, the term of this patent is extended or adjusted under 35 U.S.C. 154(b) by 0 days.

(21) Appl. No.: 09/954,401

(22) Filed: Sep. 17, 2001

(65) Prior Publication Data

US 2002/0032928 A1 Mar. 21, 2002

Related U.S. Application Data

(60) Provisional application No. 60/234,262, filed on Sep. 21, 2000.

(51) Int. Cl.[7] ..... A47B 7/02
(52) U.S. Cl. ..... 5/604; 5/617
(58) Field of Search ..... 5/604, 605, 617, 5/695, 631, 930, 612, 606

(56) References Cited

U.S. PATENT DOCUMENTS 3,877,088 A * 4/1975 Bouman ..... 5/618
3,959,833 A 6/1976 Burke
4,011,610 A 3/1977 Parker, III
4,127,906 A * 12/1978 Zur ..... 297/DIG. 10
4,207,633 A 6/1980 Smith et al.
4,222,131 A * 9/1980 Holdt et al. ..... 5/617
4,472,848 A 9/1984 Newman
4,620,333 A 11/1986 Ritter
4,689,842 A 9/1987 Kuhn
5,001,790 A 3/1991 Kuhn
5,077,845 A * 1/1992 Tokunaga et al. ..... 4/237
5,081,721 A * 1/1992 Stefano ..... 5/604
5,327,599 A * 7/1994 Bradley, Jr. ..... 5/604
5,351,349 A * 10/1994 Tsai et al. ..... 5/604
5,392,479 A * 2/1995 Liao ..... 5/607
5,394,571 A 3/1995 Vernon
6,523,198 B1 * 2/2003 Temple ..... 5/604

* cited by examiner

*Primary Examiner*—J. J. Swann
*Assistant Examiner*—Katherine Mitchell
(74) *Attorney, Agent, or Firm*—Connolly Bove Lodge & Hutz LLP

(57) ABSTRACT

A bed assembly for invalids or patients includes a bed frame assembly having an opening provided near a center portion thereof. A mattress is provided on the bed frame assembly and has an opening provided therein for receiving a non-rigid, inflatable insert having an opening. The insert opening communicates with the bed frame assembly opening. The bed assembly further includes a waste container that is slideably received on a bottom portion of the bed frame assembly. The waste container also has an opening that communicates with the non-rigid, inflatable insert opening and the bed frame assembly opening.

14 Claims, 2 Drawing Sheets

BED ASSEMBLY WITH AN INSERT FOR INVALIDS

CLAIM OF PRIORITY

Priority is claimed under 35 U.S.C. §119(e) from U.S. Provisional Application Ser. No. 60/234,262, filed Sep. 21, 2000, the disclosure of which is herein incorporated by reference in its entirety.

BACKGROUND OF THE INVENTION

A. Field of the Invention

The present invention relates to a combination mattress with a through-hole into which an inflatable mattress insert is positioned with a utility insert such as a basin, bedpan and the like for use with a bed to assist invalids. The mattress insert is removably received in the through-hole in the mattress. The bed supports the mattress and the inflatable mattress insert when the same is positioned in the through-hole in the mattress.

B. Description of the Related Art

Many attempts have been made to provide suitable commode mechanisms for assisting invalids who must necessarily perform bodily functions while laying on a bed. Still, the usual system involves inserting a conventional bedpan under the patient. Such bedpans, however, are made of plastic or a coated metal, and thus, are rigid, and even though they are shaped to some extent to conform to the body, at best they are always uncomfortable. In many cases a rigid bedpan is painful, especially where the patient is thin, has bed sores, is bruised, or is otherwise injured. In some cases, long term use of rigid bedpans will cause bed sores and shearing of the skin. Further, lifting a patient can be physically stressful if not impossible for attendants, particularly a home caregiver. If a patient is paralyzed, experiences pain on moving, or is simply weak, more than one attendant may be required to lift the patient's hips high enough to allow insertion of the bedpan under the buttocks. Alternatively, the attendants may turn the patient on his/her side before placing the bedpan and then rotate the patient back on to the bedpan. Either of these procedures may cause extreme discomfort, or even further injury to the patient. Further, waste cleanup is aesthetically unpleasant, not only because of the sight and smell, but because flushing of the body excrement is usually impossible.

The significance of the problem is attested by the many patents in this area, including patents related to inflatable bedpans, such as U.S. Pat. No. 5,394,571 to Vernon, for an "Inflatable bedpan with disposable liner" and the prior art cited therein. Thus there is a need in the art to provide a bed assembly having a non-rigid mattress insert and waste container that are removable for easy cleaning.

SUMMARY OF THE INVENTION

The present invention satisfies the need of the related art by providing a combination mattress with a through-hole into which an inflatable mattress insert is positioned with a utility insert such as a basin, bedpan and the like for use with a bed to assist invalids. The mattress insert is removably received in the through-hole in the mattress. The bed supports the mattress and the inflatable mattress insert when the same is positioned in the through-hole in the mattress.

As embodied and broadly described herein, the present invention is broadly drawn to a bed assembly for invalids. The bed assembly includes a bed frame assembly having an opening provided near a center portion thereof, and a mattress provided on the bed frame assembly and having an opening provided therein. A non-rigid, inflatable insert is provided within the mattress opening, the insert has an opening that communicates with the bed frame assembly opening. The bed assembly further includes a waste container that is slideably received on a bottom portion of the bed frame assembly. The waste container has an opening that communicates with the non-rigid insert opening and the bed frame assembly opening.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DESCRIPTION OF AN EMBODIMENT OF THE PRESENT INVENTION

The following detailed description of the invention refers to the accompanying drawings. The same reference numbers in different drawings identify the same or similar elements. Also, the following detailed description does not limit the invention. Instead, the scope of the invention is defined by the appended claims and equivalents thereof.

Figure 2:
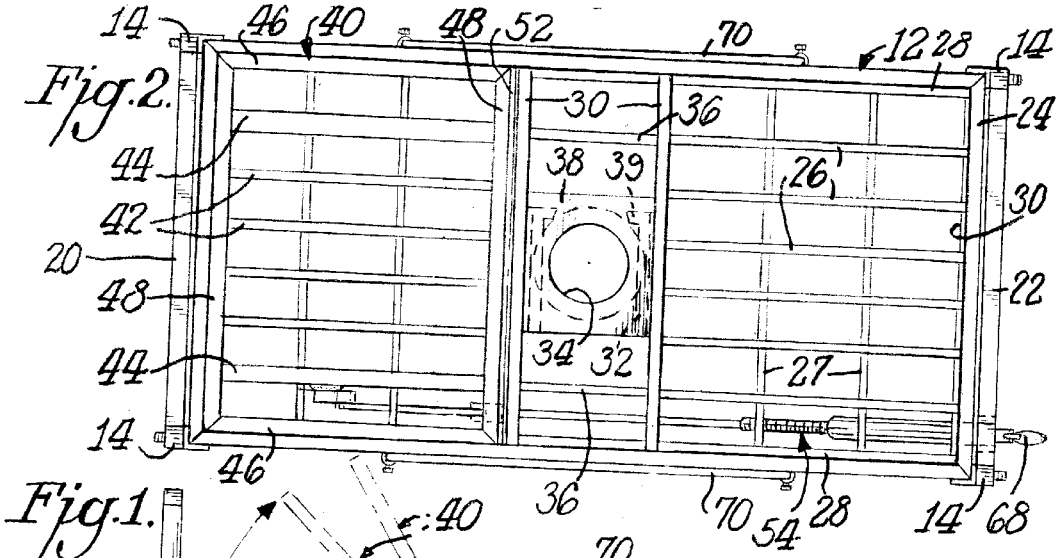
FIG. 2 is a top plan view of the bed assembly and insert for invalids shown in FIG. 1.
Figure 3:
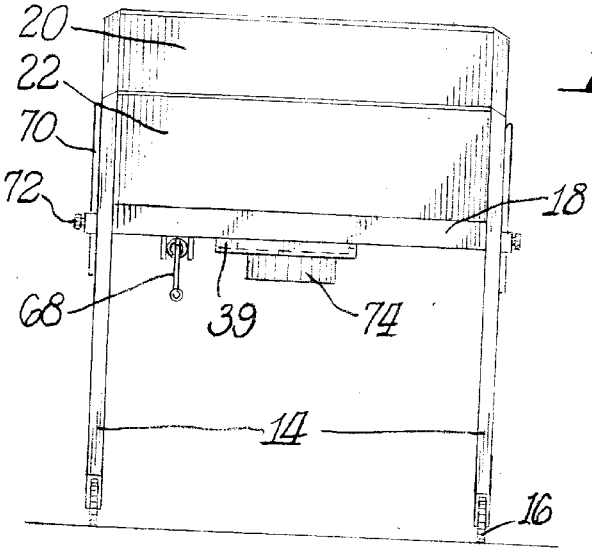
FIG. 3 is a right end elevational view of the bed assembly and insert for invalids shown in FIGS. 1 and 2.

Referring now specifically to the drawings, an embodiment of the bed assembly with an insert for invalids of the present invention is illustrated in FIGS. 1–5, and shown generally as reference numeral 10. The bed assembly 10 includes a bed frame assembly 12 having four support members 14, each support member 14 optionally having a roller or caster 16 attached at the bottom portion thereof. One pair of support members 14 are interconnected by a pair of transverse support members 18, and the other pair of support members 14 are interconnected by another pair of transverse support members 18, via plurality of connecting mechanisms such as rivets, screws, nuts and bolts, etc. A headboard 20 (as best seen in FIG. 3) is fitted between one pair of support members 14 and their corresponding pair of transverse support members 18, and a baseboard or footboard 22 is fitted between the other pair of support members 14 and their corresponding transverse support members 18. A bed frame 24 interconnects with support members 14 via a plurality of connecting mechanisms such as rivets, screws, nuts and bolts, or any other similar type known in the art.

A plurality of fixed support rails 26 and two fixed reinforced outside support rails 28 interconnect with a pair of reinforced end support rails 30. Transverse support rails 27 may also be provided, and interconnect with reinforced support rails 28. Rails 26, 28, 30 are provided at a lower portion of and interconnect with bed frame 24. A bedpan frame portion 32 having an opening 34 is provided at a central portion of bed frame 24. Bedpan frame portion 32 includes a pair of fixed support rails 36, and a bedpan support block 38 having L-shaped tracks 39 for receiving and positioning a bedpan. Support rails 36 and bedpan support block 38 interconnect with end support rails 30. A moveable frame portion 40 is provided at an upper portion of bed frame 24. Moveable frame portion 40 includes a plurality of support rails 42, reinforced, wider support rails 44, and outer, reinforced support rails 46 that interconnect with a pair of reinforced end support rails 48. Moveable frame portion 40 may further include transverse support rails 50 that interconnect with reinforced support rails 46.

Moveable frame portion 40 may be moveably attached to bedpan frame portion 32 by providing a hinge 52 to pivotally connect one end support rail 48 of moveable frame portion 40 to one end support rail 30 of bedpan frame portion 32. Moveable frame portion 40 may be moved upward or downward via a moveable frame raising assembly 54 to enable a patient or invalid to be manipulated between a seated, upright position and a lying down, flat position.

Figure 1:
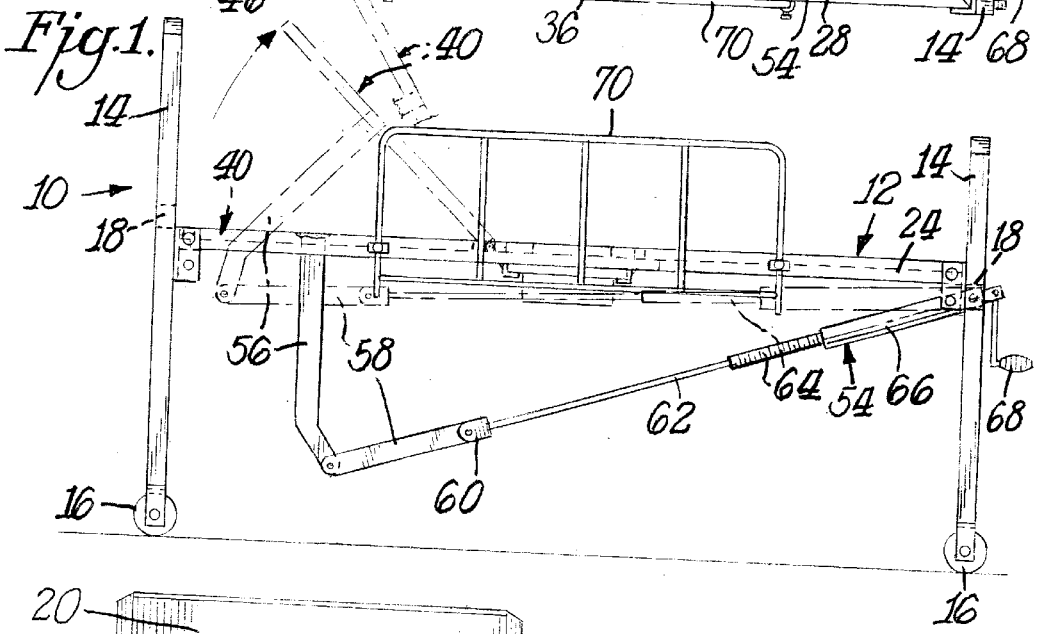
FIG. 1 is a side elevational view of a bed assembly with an insert for invalids in accordance with an embodiment of the present invention and showing an upper body support in phantom outline at different positions.

As best shown in FIG. 1, moveable frame raising assembly 54 includes a raising bar 56 that interconnects with a support rail 44 and pivotally connects to a connector 58. Connector 58 pivotally connects to a U-shaped clip 60 that is interconnected with a rod 62. Rod 62 interconnects with a threaded lead screw 64, a portion of which is provided within a cylinder 66 and threadably connects with a threaded nut (not shown) also provided within cylinder 66. A portion of lead screw 64 extends away from cylinder 66 and interconnects with a crank mechanism 68. To raise moveable frame portion 40, depending upon whether the threads of lead screw 64 are left-hand or right-hand threads, user (nurse, care giver, etc.) need only rotate crank mechanism 68 in one direction to cause cylinder 66 to move on lead screw 64 towards rod 62, which, in turn, causes raising bar 56 and moveable frame portion 40 to move upwards. Rotating crank mechanism 68 in the opposite direction will cause cylinder 66 to move on lead screw 64 away from rod 62, which, in turn, causes raising bar 56 and moveable frame portion 40 to move downward.

As shown in FIGS. 1–3, a pair of side railings 70 may be provided with bed frame assembly 12 to prevent the invalid or patient from falling out of the bed assembly 10. Thumb screws 72 may also be employed to permit adjustment of the heights of side railings 70. Furthermore, as best shown in FIG. 3, a round waste container 74 having a rim 76 may be positioned underneath bedpan support block 38 and retained by L-shaped tracks 39. Waste container 74 may receive bodily functions of a patient or invalid utilizing the bed assembly 10 of the present invention.

The entire bed frame assembly 12, including the moveable frame raising assembly 54, may be made from a variety of materials. For example, bed frame assembly may be constructed of iron, steel, aluminum, wood, etc.

Figure 4:
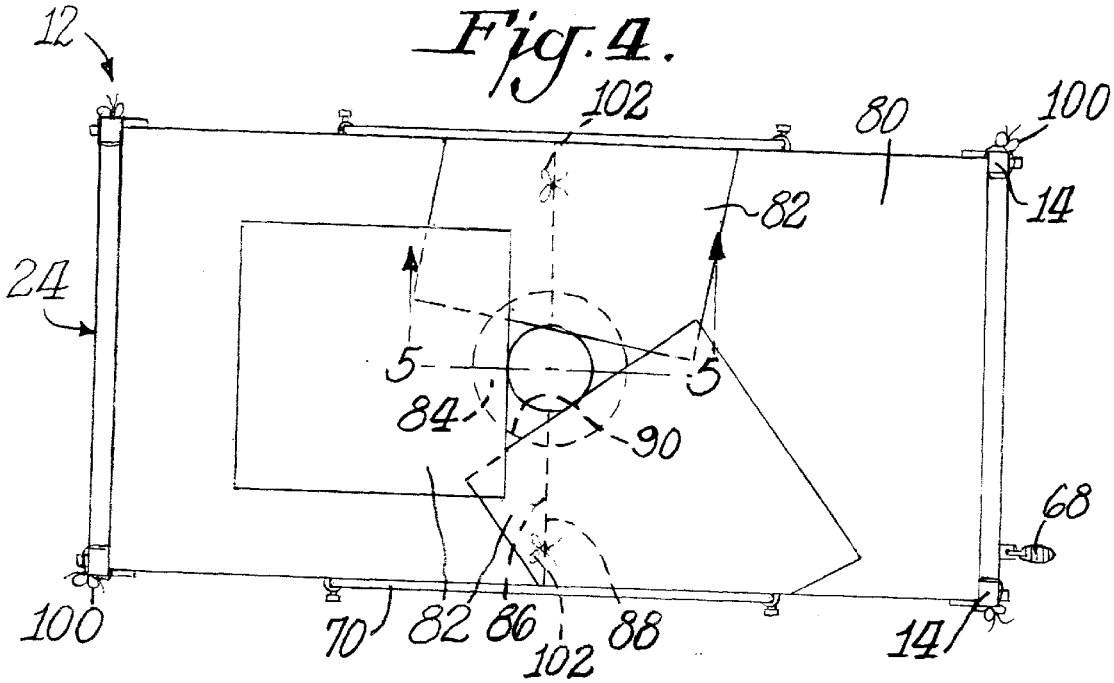
FIG. 4 is a top plan view of the bed assembly and insert for invalids shown in FIGS. 1–3 and showing mattress sections, a disposable bedpan, and a sheet cover disposed on the bed assembly.
Figure 5:
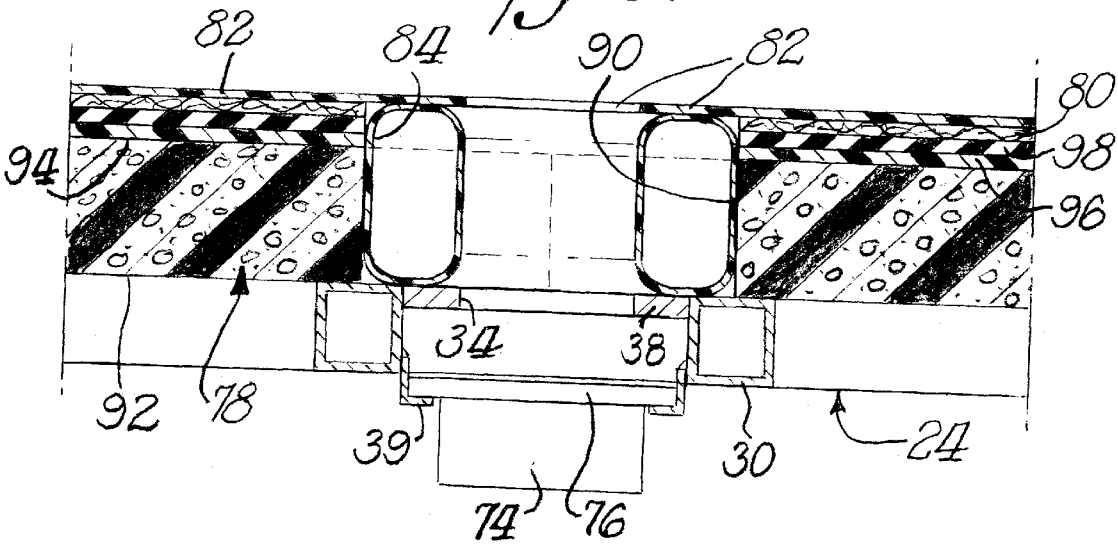
FIG. 5 is a partial cross-sectional view of the bed assembly and insert for invalids shown in FIGS. 1–4, taken along line 5—5 of FIG. 4.

Referring to FIGS. 4 and 5, a mattress 78, a sheet 80, and three overlapping bed pads 82 for use in combination with an inflatable insert 84 and waste container 74, may be used with and supported by the bed frame assembly 12 shown in FIGS. 1–3. Although three bed pads 82 are shown in FIG. 4, more or less than three bed pads 82 may be used with the present invention.

Mattress 78 has opposite edge portions 86 and 88 and an opening 90 provided at a central portion thereof to removably receive inflatable insert 84 therein. Mattress 78 may be made of any suitable resilient structure and is preferably formed of foam rubber or similar resilient material that will conform to fit and support a person comfortably thereon. Mattress 78 may be integrally formed have opening 90 provided therein. Alternatively, mattress 78 may be formed of two components, each component having a semi-circular opening at opposing edges of the mattress components. Semi-circular openings thus form circular opening 90 when the mattress components abuttingly contact one another. Tie strings 102 may then be used to hold the two mattress components together.

Mattress 78 is generally rectangular and has a first surface 92 and a second surface 94 whereby the mattress 78 is reversible. The mattress 78 is preferably enclosed within a cover or envelope 96 of suitable fabric or sheet material, such as plastic, nylon, polyethylene, or the like, that is naturally or treated to be water resistant or repellant. In the structure illustrated, mattress 78 has cover 96 engaging the surface of a resilient material 98, such as, for example, a rubber mat, and the cover or envelope 96 may be connected or closed, for example, by rolled seams or the like at all corner or edge portions of mattress 78. Rubber mat 98 prevents sheet 80 from sliding on water repellant cover 96.

Sheet 80, preferably made of thick, quilted cotton, may be disposed over resilient material (rubber mat) 98. If sheet 80 is provided, it should have an opening that communicates with the opening 90 formed in mattress 78. Sheet 80 may be held in position by rubber mat 98, as well as tie strings 100 provided at the corners of sheet 80 and tied to each support member 14.

The three overlapping disposable bed pads 82 are then provided over sheet 80 to surround opening 90 and prevent sheet 80 from being soiled by the bodily fluids of the invalid or patient. Pads 82 may be made from a variety of materials, but preferably are made from a material that absorbs fluids such as bodily fluids.

The mattress insert 84 is preferably made of an inflatable, resilient material such as rubber, and when inflated, has the substantially the same height as the thickness of the mattress 78 to provide identical body supporting characteristics in order for mattress 78 and insert 84 to act and feel as one piece in supporting a person. The mattress insert 84 is generally tubular or doughnut shaped, whereby insert 84 may be reversibly provided in opening 90 of mattress 78.

As shown in FIGS. 4 and 5, bed frame assembly 12 supports mattress 78, quilted sheet 80, and bed pads 82, insert 84, cover 96, rubber mat 98, and waste container 74. Bed frame assembly 12 may be fixed, or may be movable between a first position having mattress 78 horizontal (see FIG. 1) and a second chair-like position having one end of mattress 78 inclined upwardly while the other end of mattress 78 remains horizontal, as is normally found in conventional hospital beds.

As further shown in FIG. 5, the opening of the inflatable insert 84 communicates with the opening 34 provided in bed frame 24, the opening 90 provided in mattress 78, and the opening provided in waste container 74. This provides a non-rigid comfortable bedpan arrangement, wherein the waste material (bodily fluids) may be quickly and easily disposed. In use, the inflatable insert 84 and waste container 74 are assembled and placed under the patient or invalid. By this method, a minimum amount of lifting of the patient is necessary, reducing the stress on both the attendant and the patient. The present invention also permits washing and air flow to the perineal areas of the patient.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A bed assembly, comprising:

a bed frame assembly having an opening provided near a center portion thereof;

a mattress provided on the bed frame assembly and having an opening provided therein;

a non-rigid, inflatable, removable and reversible insert received in the mattress opening, the non-rigid, having an opening that communicates with the bed frame assembly opening; and a waste container having a rim that is slideably and directly received on L-shaped brackets provided on a bottom portion of the bed frame assembly, the waste container having an opening that communicates with the non-rigid insert opening and the bed frame assembly opening.

2. A bed assembly as recited in claim 1, wherein the bed frame assembly comprises a moveable frame raising assembly that is capable of moving a portion of the bed frame assembly and a person using the bed assembly to an upright position.

3. A bed assembly as recited in claim 2, wherein the moveable frame raising assembly comprises:

a raising bar;

a threaded lead screw interconnected with the raising bar;

a cylinder having a threaded nut for receiving a portion of the threaded lead screw; and a crank mechanism connected to a portion of the threaded lead screw to raise a portion of the bed frame assembly.

4. A bed assembly as recited in claim 1, further comprising a plurality of bed pads disposed around the opening of the mattress.

5. A bed assembly as recited in claim 4, wherein the plurality of bed pads comprises three overlapping bed pads.

6. A bed assembly as recited in claim 1, further comprising a water resistant or repellant cover provided over a top surface of the mattress.

7. A bed assembly as recited in claim 6, wherein the water resistant or repellant cover comprises a material selected from the group consisting of plastic, nylon, and polyethylene.

8. A bed assembly as recited in claim 6, further comprising a resilient material provided on the top surface of the water resistant or repellant cover.

9. A bed assembly as recited in claim 8, wherein the resilient material comprises a rubber material.

10. A bed assembly as recited in claim 8, further comprising a sheet disposed on the top surface of the resilient material.

11. A bed assembly as recited in claim 10, further comprising a plurality of bed pads disposed on the sheet and around the opening of the mattress.

12. A bed assembly as recited in claim 1, wherein the non-rigid, inflatable insert, when inflated, has the substantially the same height as the thickness of the mattress.

13. A bed assembly as recited in claim 1, wherein the non-rigid, inflatable insert is tubular or doughnut shaped.

14. A bed assembly as recited in claim 1, wherein the waste container is capable of receiving bodily fluids from a person using the bed assembly.

* * * * *

UNITED STATES PATENT AND TRADEMARK OFFICE

CERTIFICATE OF CORRECTION

PATENT NO. : 6,647,571 B2
DATED : November 18, 2003
INVENTOR(S) : Deanna Hynansky It is certified that error appears in the above-identified patent and that said Letters Patent is hereby corrected as shown below:

Column 5,
Line 18, after "non-rigid," insert -- inflatable insert --.

Signed and Sealed this

Sixteenth Day of March, 2004

JON W. DUDAS
*Acting Director of the United States Patent and Trademark Office*